US005979384A

United States Patent [19]

Oka et al.

[11] Patent Number: 5,979,384

[45] Date of Patent: Nov. 9, 1999

[54] VALVE DEVICE FOR ENGINE

[75] Inventors: Toshihiko Oka; Takao Ichimura; Shuji Nagano, all of Tokyo, Japan

[73] Assignee: Mitsubishi Jidosha Kogyo Kabushiki Kaisha, Tokyo, Japan

[21] Appl. No.: 08/973,703

[22] PCT Filed: Apr. 4, 1997

[86] PCT No.: PCT/JP97/01158

§ 371 Date: Dec. 8, 1997

§ 102(e) Date: Dec. 8, 1997

[87] PCT Pub. No.: WO97/38211

PCT Pub. Date: Oct. 16, 1997

[30] Foreign Application Priority Data

Apr. 8, 1996 [JP] Japan ..... 8-120762

[51] Int. Cl.[6] ..... F01L 1/18

[52] U.S. Cl. ..... 123/90.42; 123/90.5; 123/90.51

[58] Field of Search ..... 123/90.39, 90.42, 123/90.48, 90.5, 90.51

[56] References Cited

U.S. PATENT DOCUMENTS 3,628,514 12/1971 Phillips ..... 123/90.48

5,010,856 4/1991 Ojala ..... 123/90.36

FOREIGN PATENT DOCUMENTS

| | | |
|---|---|---|
| 0296291A2 | 12/1988 | European Pat. Off. . |
| 48-25694 B1 | 4/1973 | Japan . |
| 58-113627 | 7/1983 | Japan . |
| 64-32403 | 3/1989 | Japan . |
| 4-282013 | 10/1992 | Japan . |
| 5-22085 B2 | 3/1993 | Japan . |
| 6-229421 | 8/1994 | Japan . |

*Primary Examiner*—Weilun Lo

[57] ABSTRACT

A valve system for driving intake and exhaust valves of an engine has a roller shaft 9 mounted in a recess 5 of a rocker arm body 1 (or a tappet body 21) as a valve system body, a cylindrical bushing 3 rotatably supported by the roller shaft 9, and a roller 2 rotatably supported on the outer periphery of the bushing 3 and opposite a cam 11, in which a lubricating film A is provided on each of the surfaces of sliding contact of the bushing 3 with the roller shaft 9 and with the roller 2, so that the lubricating film A enables the valve system to act smoothly for a long term, without causing loss of the lubricating properties of the slide surfaces 12, 13 of the bushing 3, even in the state of undersupply of an lubricating oil that occurs at the initial stage of operation of the engine.

9 Claims, 3 Drawing Sheets

VALVE DEVICE FOR ENGINE

This application claims the benefit under 35 U.S.C. §371 of prior PCT International Application No. PCT/JP97/01158 which has an International filing date of Apr. 4, 1997 which designated the United States of America, the entire contents of which are hereby incorporated by reference.

TECHNICAL FIELD

This invention relates to a valve system for driving intake and exhaust valves of an engine.

BACKGROUND ART

A conventional valve system for an intake and exhaust valve mechanism of an engine has a roller provided at a location opposed to a cam to smooth sliding contact between the valve system and the cam.

The structure of this roller is disclosed, for example, in Japanese Patent Publication No. 22085/93 or Japanese Laid-Open Utility Model Publication No. 32403/89. This structure has a bushing type bearing interposed between a roller and a roller shaft, or has a needle bearing interposed between a roller and a roller shaft. In either structure, the occurrence of wear due to the friction of the roller with a rocker arm body inhibits the smooth action of the valve system, and shortens the life of the valve system.

The structure disclosed in Japanese Patent Publication No. 22085/93 has an oil groove provided on the circumference of the outer periphery of the roller shaft for holding a lubricating oil, and an oil hole provided in the bushing to smooth the supply of the lubricating oil to the inner peripheral surface and outer peripheral surface of the bushing, thereby enhancing a bearing function. The structure disclosed in Japanese Laid-Open Utility Model Publication No. 32403/89 has a solid lubricant film coated on the recessed inner surface of a rocker arm corresponding to both side surfaces of the needle roller, thereby reducing wear of a partial slide surface between the roller and the rocker arm body.

The structure disclosed in Japanese Laid-Open Utility Model Publication No. 32403/89, however, poses considerable difficulty in doing work for coating the solid lubricant film only on the inner peripheral surface of the narrow recess of the rocker arm body. This work makes the manufacturing process tiresome and raises the cost of the product. Furthermore, lubrication between the needle bearing and each of the roller and roller shaft depends on the oil supplied from the end of the needle bearing. This results in poor lubricating performance at the initial stage of engine operation.

The structure disclosed in Japanese Patent Publication No. 22085/93, on the other hand, has the oil groove provided in the roller shaft, and the oil hole in the bushing, in order to maintain satisfactory lubrication of the inner and outer peripheral surfaces of the bush. This makes the manufacturing process for the roller shaft and bushing tiresome, and raises the cost of the product. In addition, burrs occurring during formation of the oil groove and the oil hole damage the slide surfaces of the bushing, roller, and roller shaft. The provision of the oil groove in the bushing also decreases the area of sliding contact of the bushing with the roller and the roller shaft, thus increasing the load per unit area of the bushing slide surface that is generated at the push of the roller by the cam. This leads to decreased durability of the bushing.

Usually, lubrication for the entire valve system is performed by the penetration of lubricating oil splashes flying from around the valve system. Particularly at the initial stage of operation, such as at the start of the engine, the temperature is low and the viscosity of the lubricating oil is high, so that penetration of splashes is minimal. With a valve system of the rocker arm type, moreover, it takes time for the lubricating oil to ascend to the cylinderhead. Partly for this reason, lubrication of the roller and the bushing may be insufficient. Even with the structure disclosed in Japanese Patent Publication No. 22085/93, formation of a lubricating film is difficult at the start of the engine, and at the initial stage of operation, in particular. This may cause a marked damage to the valve system, such as scoring of the surface of sliding contact between the bushing and each of the roller shaft and the roller.

Besides, the area of sliding contact between the bushing and each of the roller shaft and the roller is larger than in a valve system using a needle bearing. Thus, friction increases, but the area of sliding contact is nearly uniform in the direction of the roller width, so that the lubricating oil film becomes minimally discontinuous. With a valve system using a needle bearing, on the other hand, the area of sliding contact between the needle bearing and each of the roller shaft and the roller is smaller than in a valve system using a bushing. Thus, friction in the entire needle bearing is small, but the needle bearing may be inclined relative to the central axis of the roller. As a result, friction occurs unevenly in the width direction of the needle bearing. The lubricating oil film becomes nonuniform in the direction of the roller width, making the lubricating film apt to become discontinuous.

This problem may be pronounced particularly in the case of an engine, such as a diesel engine, in which a lubricating oil may become easily contaminated with impurities (e.g., soot). In this type of engine, the use of a valve system with a needle bearing inserted therein can make a lubricating film formed on the peripheral surface of the needle roller discontinuous even more easily, because of the small area of sliding contact of the needle bearing and impurities involved in the lubricating oil. Thus, the wear of the valve system may be aggravated. Even when a solid lubricant film is formed on the entire needle bearing, friction occurs nonuniformly. Thus, the solid lubricant film can be damaged easily, and wear of the valve system is difficult to reduce sufficiently.

The present invention has been accomplished in the light of the above circumstances. Its object is to provide a valve system of an engine which is adapted to act smoothly for a long term, without causing loss of the lubricating properties of the slide surfaces of the bushing, even in the state of undersupply of the lubricating oil that occurs at the initial stage of operation of the engine.

DISCLOSURE OF THE INVENTION

A valve system of an engine, according to the present invention, for attaining the foregoing object comprises a roller shaft disposed in a recess of a valve system body, a cylindrical bushing rotatably supported by the roller shaft, and a roller rotatably supported on the outer periphery of the bushing and rotating opposite a cam, wherein a lubricating film is provided on each of the surfaces of sliding contact of the bushing with the roller shaft and with the roller.

Thus, the valve system can act smoothly for a long term, without causing loss of the lubricating properties of the slide surfaces of the bushing, even in the state of undersupply of the lubricating oil that occurs at the initial stage of operation of the engine.

The invention also concerns the valve system of an engine in which the surfaces of sliding contact as the outer peripheral surface and the inner peripheral surface of the bushing are formed so as to be continuous.

Thus, the surface of sliding contact can be enlarged, and the durability of the bushing can be improved, thus ensuring the long-term use of the valve system.

The invention also concerns the valve system of an engine in which the lubricating film is provided on the entire surface of the bushing.

Thus, the lubricating properties between the bushing and both of the shaft supporting walls against friction are retained. Also, wear of the sliding contact surfaces of the valve system associated with insufficient lubrication at the start of the engine is prevented. Hence, the valve system can be used for a long term without damage.

The invention also concerns the valve system of an engine in which the bushing is formed of a material having practically the same coefficient of linear thermal expansion as that of the roller.

Thus, the clearance between the roller and the bushing can be kept constant regardless of the engine temperature. Hence, the valve system can be used without damage for a long term with the inhibition of rotation of the bushing and roller being prevented.

BEST MODE FOR CARRYING OUT THE INVENTION

Embodiments of the present invention will now be described.

Figure 1:
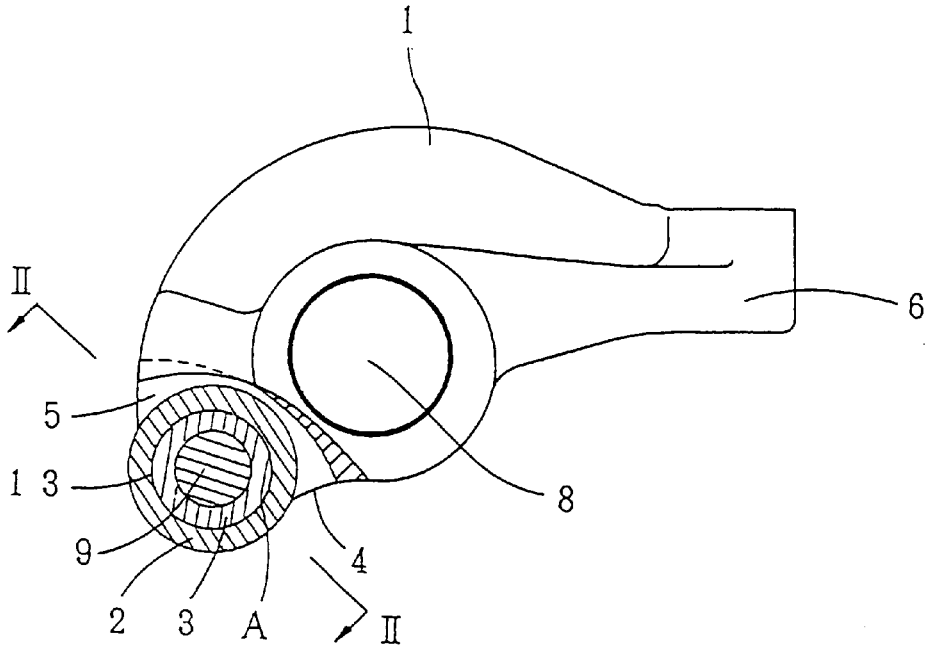
FIG. 1 is a partial sectional front view of a valve system of an engine according to the present invention as applied to a roller rocker arm.
Figure 2:
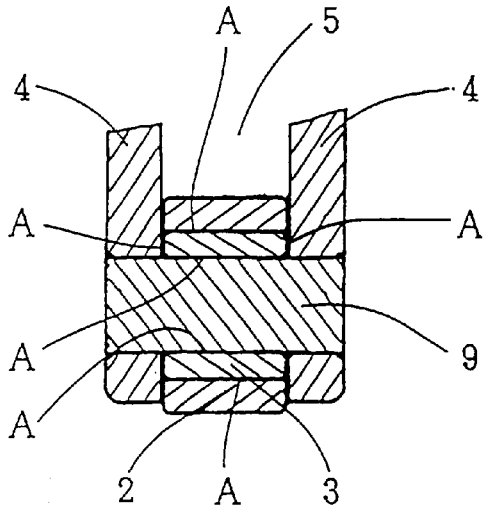
FIG. 2 is a sectional view taken along line II—II of FIG. 1.
Figure 4:
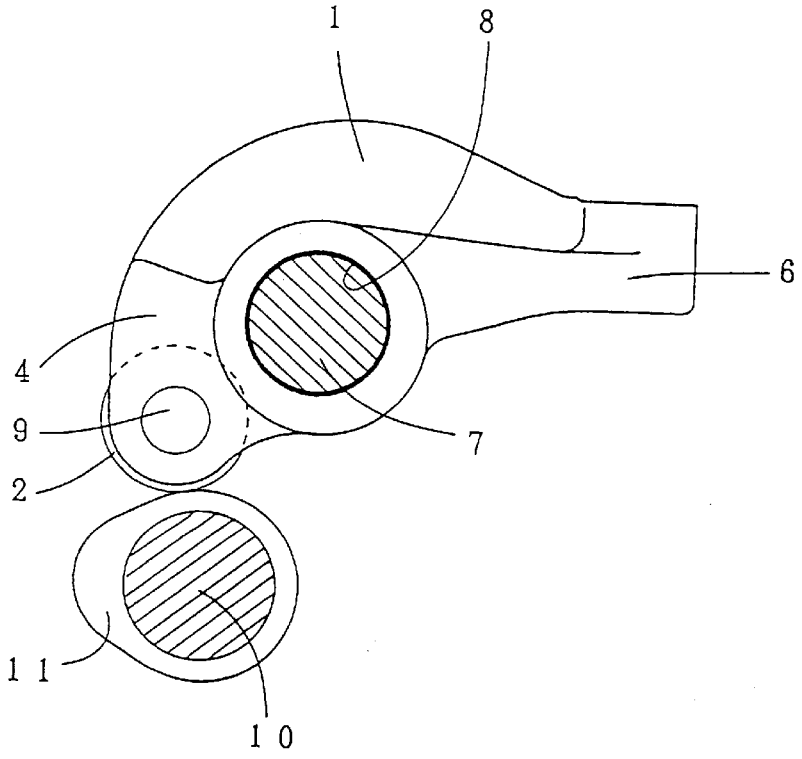
FIG. 4 is a front view showing the corresponding relation of the roller rocker arm with other parts.

As shown in FIGS. 1, 2 and 4, the numeral 1 denotes a rocker arm body. At one end part of the rocker arm body 1, a pair of shaft supporting walls 4, which form a recess 5 for mounting a roller 2 and a cylindrical bush 3, are provided. At the other end part of the rocker arm body 1, a valve holding portion 6 is provided for contacting valve stems of intake and exhaust valves (not shown). At a central part of the rocker arm body 1, a through-hole 8 is provided for insertion of a rocker shaft 7.

In the recess 5, the bushing 3 to be supported by a roller shaft 9, installed between the pair of shaft supporting walls 4, is mounted rotatably. The aforementioned roller 2 is rotatably mounted via the bushing 3, and is disposed such that a part of its outer peripheral surface slightly protrudes from the periphery of the supporting walls 4 of the rocker arm body 1. This protrusion of the roller 2 makes contact with a cam 11 formed on a cam shaft 10. The roller 2 and the bushing 3 are produced from a hard iron material, e.g., a steel material, such as a high-carbon chromium bearing steel product, a chromium steel product or a chromium molybdenum steel product, which has a hardness of 60 or more on the Rockwell C scale. The roller 2 and the bushing 3 are also produced from materials having nearly the same coefficient of linear thermal expansion.

Figure 3:
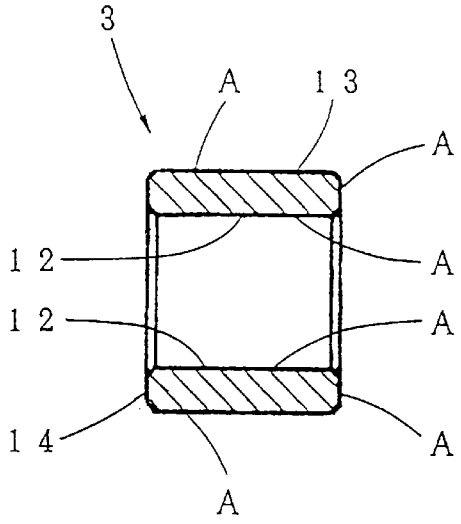
FIG. 3 is an enlarged longitudinal sectional view of the bush.

As shown in FIG. 3, a lubricating film A is formed in this bushing 3, at least on a surface 12 of sliding contact between the bushing 3 and the roller shaft 9 and on a surface 13 of sliding contact between the bushing 3 and the roller 2. Preferably, the lubricating film A is formed on the entire surface 14 of the bushing 3 including these surfaces 12, 13 of sliding contact. This lubricating film A is formed by spray coating and then baking, or dip coating and then baking, a lubricating, low abrasion coefficient film, such as a manganese phosphate-derived chemical conversion film or an epoxy film containing molybdenum disulfide.

Because of this constitution, the lubricating film A, i.e., lubricating, low wear coefficient film, formed on the surface 12 of sliding contact between the bushing 3 and the roller shaft 9 and the surface 13 of sliding contact between the bushing 3 and the roller 2, imparts lubricating properties to the surfaces 12, 13 of sliding contact even in the state of undersupply of the lubricating oil to the rocker arm portion at the start of the engine, etc. This brings not only the effect of preventing the occurrence of damage associated with insufficient lubrication between the bushing 3 and the roller shaft 9 and between the bushing 3 and the roller 2, but also the effect of maintaining even better lubricating properties even after the supply of the lubricating oil. In accordance with the rotation of the cam 11, a pressing force acts on the bushing 3 via the roller 2. However, the outer peripheral surface and inner peripheral surface of the bushing 3 are each smoothly continuous to form cylindrical shapes with a round cross section. Compared with the bushing 3 having an oil groove or the like, therefore, the bushing 3 of the invention gains an increased area of sliding contact, thus improving the durability of the bushing 3.

In the foregoing explanation, the sites of formation of the lubricating film A are at least on the surface 12 of sliding contact between the bushing 3 and the roller shaft 9 and the surface 13 of sliding contact between the bushing 3 and the roller 2. This is because the surface 12 of sliding contact between the bushing 3 and the roller shaft 9 and the surface 13 of sliding contact between the bushing 3 and the roller 2 are the most susceptible sites to damage during shortage of a lubricating oil, and retention of lubricating properties at these sites constitutes the minimum requirement.

When the lubricating film A is formed on the whole surface 14 of the bushing 3, the lubricating properties in the recess 5 against friction between the bushing 3 and the two shaft supporting walls 4 of the roller rocker arm are retained against the lack of a lubricating oil at the start of the engine. Thus, abrasion and action unsmoothness due to the lack of lubrication are eliminated. Even after the supply of a lubricating oil, the lubricating properties of the various parts can be maintained at an even more satisfactory level. Furthermore, the bushing 3 and the roller 2 are manufactured from materials having nearly the same coefficient of linear thermal expansion. Even when the bushing 3 and the roller 2 expand owing to changes in the engine temperature, the clearance between the bush 3 and the roller 2 can be kept constant, so that the rotation of the bushing 3 and the roller 2 is not impeded. Furthermore, it becomes possible to set the clearance between the bushing 3 and the roller 2 at a minute value. This gives the effect of reducing noises and vibrations generated between the bushing 3 and the roller 2.

Another embodiment of the present invention will be described. The members having the same functions as explained in the aforementioned embodiment will be assigned the same numerals or symbols, and overlapping explanations omitted.

Figure 5:
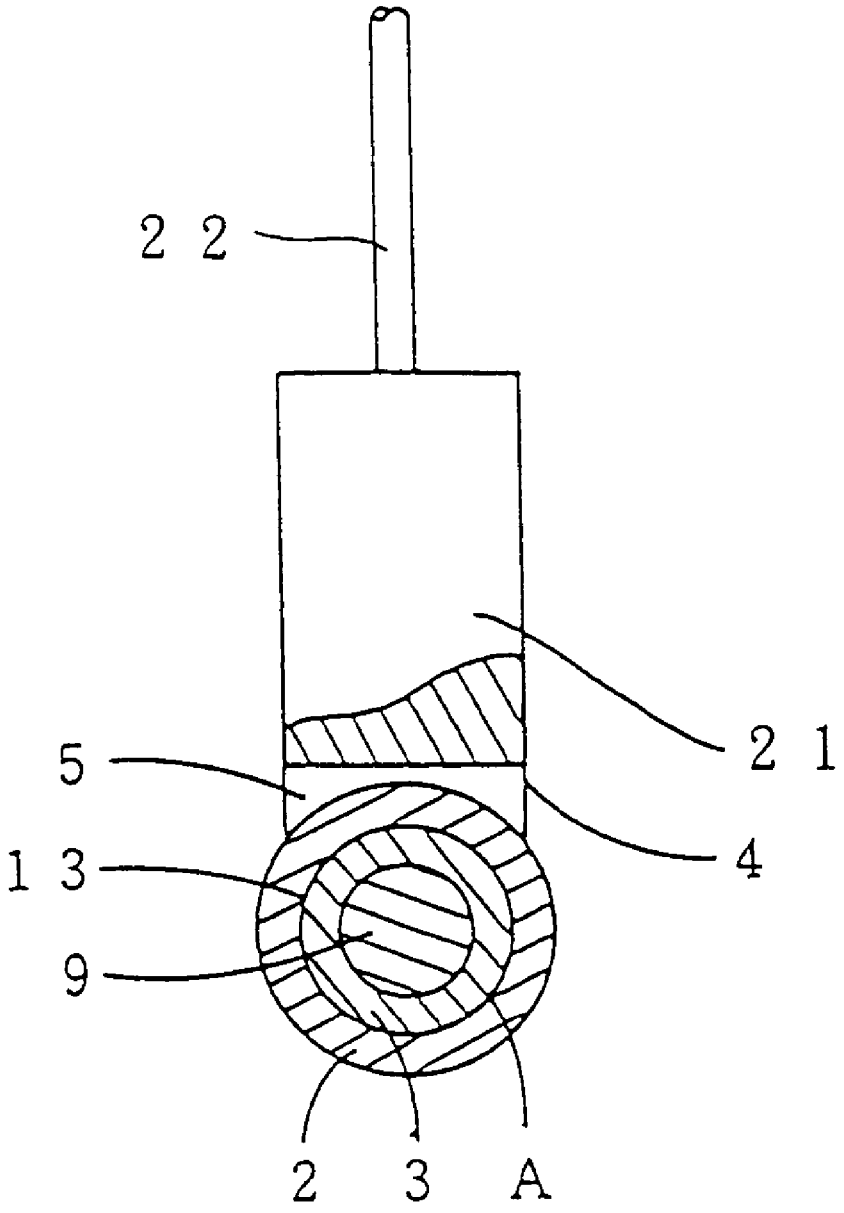
FIG. 5 is a partially cutaway front view of the valve system of an engine according to the present invention as applied to a tappet.

As shown in FIG. 5, the numeral 21 denotes a tappet body. At one end part of the tappet body 21, a pair of shaft supporting walls 4, which form a recess 5 for mounting a roller 2 and a cylindrical bushing 3, are provided. At the other end part of the tappet body 21, a push rod 22 is provided for driving intake and exhaust valves (not shown). In the recess 5, the bushing 3 is mounted rotatably by a roller shaft 9 installed between the pair of shaft supporting walls 4. The roller 2 is rotatably mounted via the bushing 3, and is disposed such that a part of its outer peripheral surface slightly protrudes from the periphery of the supporting walls 4 of the tappet body 21. A lubricating film A is formed on the entire surface 14 of the bushing 3 including a surface 12 of sliding contact between the bushing 3 and the roller shaft 9, as shown in FIG. 3.

Because of the foregoing constitution, the valve system of an engine according to the instant embodiment can obtain the same actions and effects as in the aforementioned embodiment.

Embodiments of the present invention are not restricted to these embodiments concretely described above. For instance, in the above-described embodiments, only the roller and the bushing were produced from materials having nearly the same coefficient of linear thermal expansion. However, if the roller shaft is also manufactured from a material having nearly the same coefficient of linear thermal expansion, the clearance between the bushing and the roller shaft can be minimized, thus reducing noises and vibrations further. Also, the clearance between the bushing and the roller shaft can be kept constant. Hence, a valve system free from damage for a long term can be provided.

Industrial Applicability

As described above, the valve system of an engine concerned with the present invention can act smoothly for a long term, without causing loss of lubricating properties, because of a lubricating film formed on the inner and outer sliding surfaces of the bushing. This system is preferred as a valve system for driving the intake valve and exhaust valve of the engine. The valve system of the invention can be used for a roller rocker arm or a tappet.

We Claim:

1. A valve system of an engine, comprising:

a roller shaft disposed in a recess of a valve system body;

a cylindrical bushing rotatably supported by said roller shaft; and a roller rotatably supported on the outer periphery of said bushing, wherein a lubricating film is provided on each of the surfaces of sliding contact of said bushing with said roller shaft and with said roller.

2. The valve system of an engine recited in claim 1, wherein the surfaces of sliding contact at the outer peripheral surface and the inner peripheral surface of the bushing are each formed continuously.

3. The valve system of an engine recited in claim 1, wherein said lubricating film is provided on the entire surface of said bushing.

4. The valve system of an engine recited in claim 1, wherein said bushing is formed of a material having practically the same coefficient of linear thermal expansion as that of said roller.

5. The valve system of an engine recited in claim 1, wherein said bushing is formed of a material having practically the same coefficient of linear thermal expansion as that of said roller shaft.

6. The valve system of an engine recited in claim 4, wherein the material includes a high-carbon chromium molybdenum steel product.

7. The valve system of an engine recited in claim 5, wherein the material includes a high-carbon chromium molybdenum steel product.

8. The valve system of an engine recited in claim 1, wherein said lubricating film includes a manganese phosphate-derived chemical conversion film.

9. The valve system of an engine recited in claim 1, wherein said lubricating film includes an epoxy containing molybdenum disulfide.

* * * * *